US005797794A

United States Patent [19]

Angell

[11] Patent Number: 5,797,794

[45] Date of Patent: Aug. 25, 1998

[54] MULTIPLE-PLAYSTATION GAME OF CHANCE

[75] Inventor: Robert C. Angell, West Greenwich, R.I.

[73] Assignee: GTECH Corporation, West Greenwich, R.I.

[21] Appl. No.: 731,498

[22] Filed: Oct. 16, 1996

[51] Int. Cl.[6] ..... A63F 3/06

[52] U.S. Cl. ..... 463/18; 463/17; 463/42

[58] Field of Search ..... 463/16, 17, 18, 463/20, 42, 25; 273/269

[56] References Cited

U.S. PATENT DOCUMENTS

| | | | |
|---|---|---|---|
| 3,786,234 | 1/1974 | Trent et al. | 235/61.7 R |
| 3,799,553 | 3/1974 | Hurley | 273/141 A |
| 3,874,584 | 4/1975 | Foley | 234/128 |
| 4,247,106 | 1/1981 | Jeffers et al. | 273/85 G |
| 4,254,404 | 3/1981 | White | 340/311 |
| 4,477,069 | 10/1984 | Crudgington, Jr. | 272/3 |
| 4,575,085 | 3/1986 | Ollington | 273/138 R |
| 4,848,771 | 7/1989 | Richardson | 273/237 |
| 4,978,129 | 12/1990 | Komeda et al. | 273/237 |
| 5,048,831 | 9/1991 | Sides | 273/85 G |
| 5,248,142 | 9/1993 | Breeding | 273/138 R |
| 5,286,023 | 2/1994 | Wood | 463/20 |
| 5,326,104 | 7/1994 | Pease et al. | 273/138 A |
| 5,333,868 | 8/1994 | Goldfarb | 273/138 A |
| 5,340,119 | 8/1994 | Goldfarb | 273/439 |
| 5,344,199 | 9/1994 | Carstens et al. | 273/138 A |
| 5,398,932 | 3/1995 | Eberhardt et al. | 273/138 A |
| 5,401,024 | 3/1995 | Simunek | 273/138 A |
| 5,415,404 | 5/1995 | Joshi et al. | 273/138 A |
| 5,417,424 | 5/1995 | Snowden et al. | 273/138 A |
| 5,435,556 | 7/1995 | Rice et al. | 273/144 B |
| 5,472,194 | 12/1995 | Breeding et al. | 273/138 A |
| 5,472,196 | 12/1995 | Rusnak | 463/16 |
| 5,474,294 | 12/1995 | Sandeen | 273/138 A |
| 5,505,449 | 4/1996 | Eberhardt et al. | 273/138 A |
| 5,507,489 | 4/1996 | Reibel et al. | 463/17 |
| 5,536,016 | 7/1996 | Thompson | 273/269 |
| 5,540,441 | 7/1996 | Ilan et al. | 273/269 |

*Primary Examiner*—Jessica Harrison
*Attorney, Agent, or Firm*—Fish & Richardson P.C.

[57] ABSTRACT

A method of playing a game of chance, and the game of chance, include a plurality of playstations, one of which is chosen by a player for entering a quantity of player symbols, e.g., numbers. A unique game symbol is assigned to each playstation of the plurality of playstations, the game symbol being chosen from a set of game symbols, e.g., numbers. A quantity of winning symbols is randomly selected from the set of game symbols. The player wins the game if a predetermined number of the player symbols match the winning symbols or if the game symbol assigned to the player's playstation is related to one of the winning symbols in a predetermined manner, e.g., if the game number assigned to the player's playstation matches one of the winning numbers or is numerically adjacent to one of the winning numbers.

24 Claims, 3 Drawing Sheets

| PLAYSTATION 25 | |
|---|---|
| 2 | 14 |
| 6 | 25 |
| $1.00 | |

FIGURE 3

210

| PRIZE | PRIZE VALUE |
|---|---|
| LUCKY STATION | $2.00 |
| LUCKY NEIGHBOR | $1.00 |
| ONE MATCH | $1.00 |
| TWO MATCHES | $10.00 |
| THREE MATCHES | $100.00 |
| FOUR MATCHES | $1000.00 |

FIGURE 4

MULTIPLE-PLAYSTATION GAME OF CHANCE

BACKGROUND OF THE INVENTION

This invention relates to a game of chance, and in particular, a game played via a network of playstations to which game symbols are assigned.

In a traditional lotto or keno game, players choose a quantity of distinct numbers, e.g. four numbers, from a set of game numbers such as the integers from 1 to 50. The players mark the numbers they have selected on a game card and submit the card, along with a monetary wager, to a game officiant to play the game.

The game officiant then selects a series of distinct winning numbers, e.g. four numbers, from the same set of game numbers. The player is determined to be a winner if one or more of the numbers chosen by the player match the winning numbers. Typically, the prize awarded to a winner increases with the number of matches made in a particular game.

SUMMARY OF THE INVENTION

It is an object of the present invention to provide a simple, high-paced game of chance to be played in casinos and other gaming establishments.

In general, in one aspect, the invention features a method of playing a game of chance, in which a plurality of playstations is provided, one of which is chosen by a player for entering a quantity of player symbols. A unique game symbol is assigned to each playstation of the plurality of playstations, the game symbol being chosen from a set of game symbols. A quantity of winning symbols is randomly selected from the set of game symbols. The player wins the game if a predetermined number of the player symbols match the winning symbols or if the game symbol assigned to the player's playstation is related to one of the winning symbols in a predetermined manner.

Implementations of the invention may also include one or more of the following features. The player may win the game if the game symbol assigned to the player's playstation matches one of the winning symbols. The player symbols may be chosen from the set of game symbols. The player may establish a player account at the player's playstation. Finally, a prize may be automatically awarded to the player through the player's playstation.

In general, in another aspect, the invention features a method of playing a game of chance, in which a plurality of playstations is provided, one of which is chosen by a player for entering a quantity of player numbers. A unique game number is assigned to each playstation of the plurality of playstations, the game number being chosen from a set of game numbers. A quantity of winning numbers is randomly selected from the set of game numbers. The player wins the game if a predetermined number of the player numbers match the winning numbers or if the game number assigned to the player's playstation is related to one of the winning numbers in a predetermined manner.

Implementations of the invention may also include one or more of the following features. The player may win the game if the game number assigned to the player's playstation matches one of the winning numbers. The player may also win the game if the game number assigned to the player's playstation is numerically adjacent to one of the winning numbers.

The quantity of winning numbers may be chosen by a random number generator. The player numbers may be chosen from the set of game numbers.

In general, in another aspect, the invention features a game of chance to be played through a plurality of playstations. A player's playstation is chosen by a player from the plurality of playstations, each playstation capable of recording a quantity of player symbols. A unique game symbol is assigned to each playstation of the plurality of playstations, the game symbol being chosen from a set of game symbols. A symbol selector randomly selects a quantity of winning symbols from the set of game symbols. The player wins the game if a predetermined number of the player symbols match the winning symbols or if the game symbol assigned to the player's playstation is related to one of the winning symbols in a predetermined manner.

Implementations of the invention may also include one or more of the following features. The player symbols may be chosen from the set of game symbols.

The playstations may be electronic playstations. The playstations may also be interconnected via an electronic network.

Each playstation may include a display device, which may be a touch-sensitive screen. Each playstation may also include a funds acceptor for establishing a player account.

In general, in another aspect, the invention features a game of chance to be played through a plurality of playstations. A player's playstation is chosen by a player from the plurality of playstations, each playstation capable of recording a quantity of player numbers. A unique game number is assigned to each playstation of the plurality of playstations, the game number being chosen from a set of game numbers. A number selector randomly selects a quantity of winning numbers from the set of game numbers. The player wins the game if a predetermined number of the player numbers match the winning numbers or if the game number assigned to the player's playstation is related to one of the winning numbers in a predetermined manner.

Implementations of the invention may also include one or more of the following features. The player numbers may be chosen from the set of game numbers. The set of game numbers may be the set of integers from 1 through the number of the plurality of playstations.

The number selector may be a random number generator.

The game of the present invention has the advantage of allowing a large number of players to participate in a simple, high-paced game of chance in a casino environment.

Other features and advantage of the invention will become apparent from the following detailed description, and from the claims.

BRIEF DESCRIPTION OF THE DRAWINGS

FIG. 3 shows a player's wager for the game of the present invention.

FIG. 4 is a table of prize values for the wager of FIG. 3.

DESCRIPTION OF THE PREFERRED EMBODIMENTS

The game of the present invention is an interactive game of chance played by players at multiple playstations in a casino environment. In particular, the game is designed to be played on electronic playstations which are in electronic communication over a network. Alternatively, the game may be played manually, without using electronic playstations.

Figure 1:
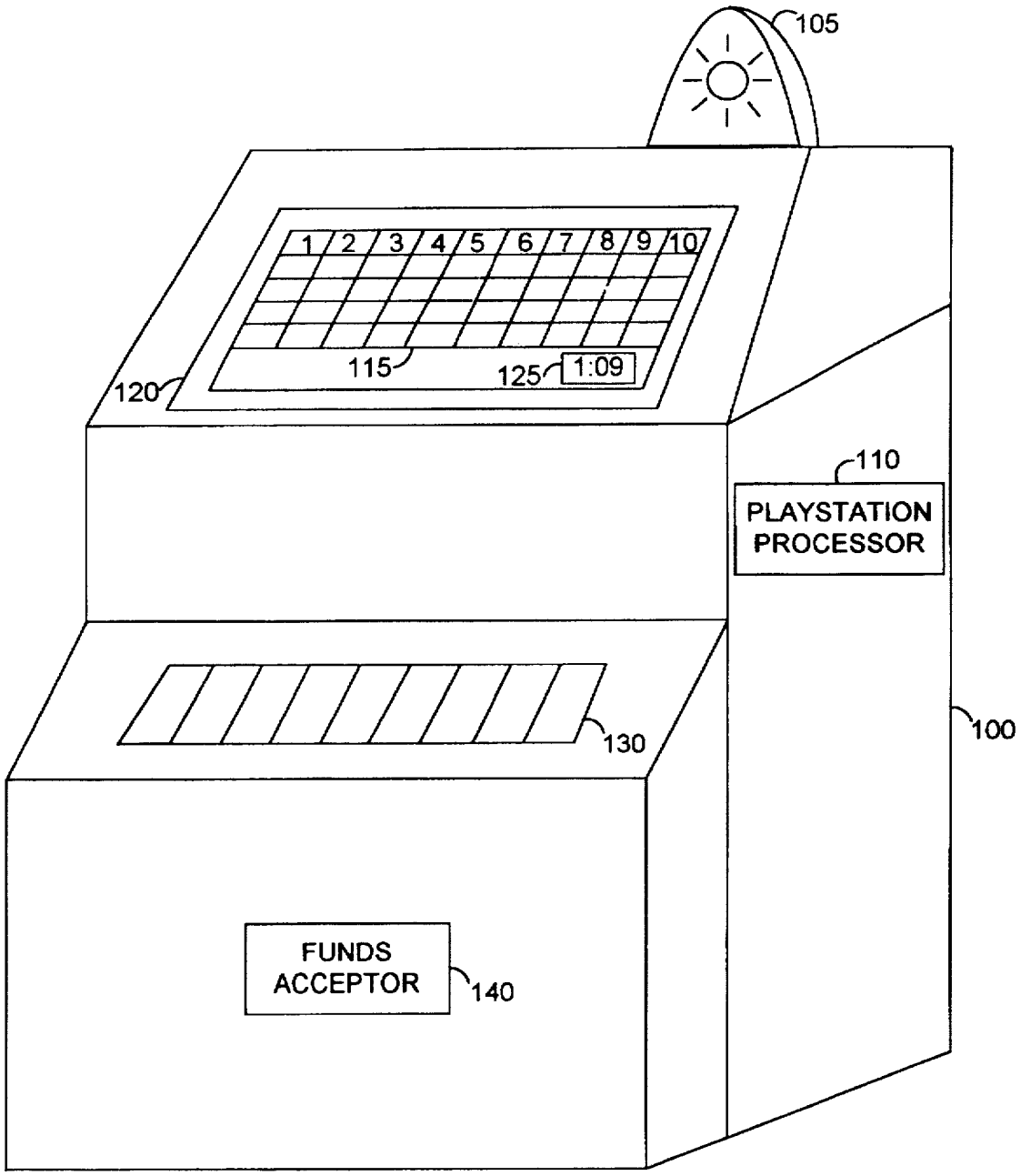
FIG. 1 shows a somewhat diagrammatic playstation for playing the game of the present invention.

As shown in FIG. 1, a playstation 100 includes a playstation processor 110 for controlling operation of playstation 100, a means, e.g. a keyboard 130, for entering information, i.e. wager data and account information, and a display device 120. Display device 120 includes any type of screen for showing the information entered by the player and for indicating the progress of the game as it is played. Preferably, display device 120 is a touch-sensitive screen through which the player may both enter and view information.

Figure 2:
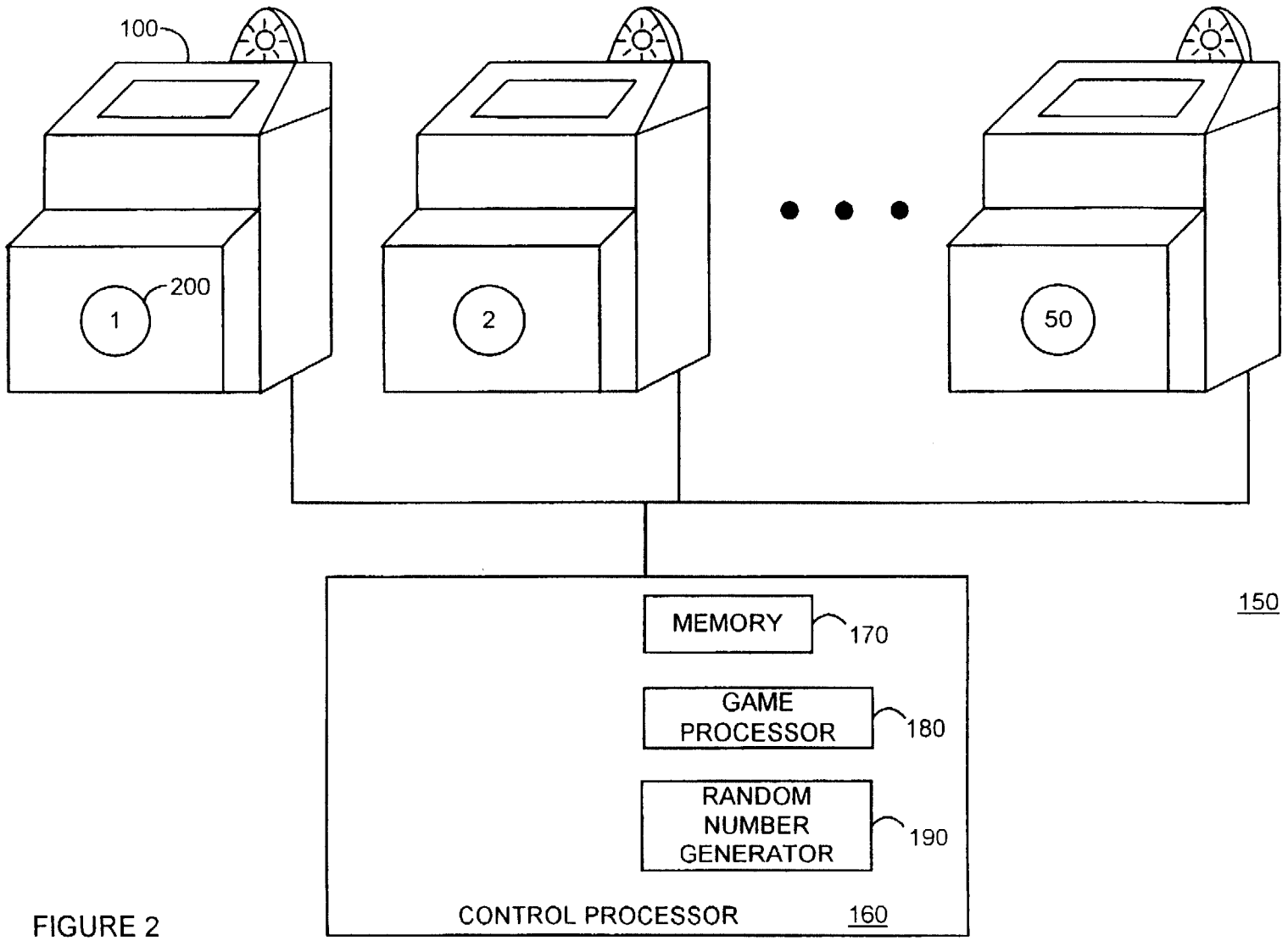
FIG. 2 shows a network of playstations as shown in FIG. 1.

As shown in FIG. 2, playstation 100 is part of a network 150 of interconnected playstations, all of which are connected to a control processor 160. Control processor 160 includes a memory 170 for storing game results and player wager data and account information, and a game processor 180 for automatically conducting play of the game.

The game involves matching game symbols. The symbols may be any type of game indicia including, e.g., numbers, icons, colors or playing cards. The embodiment described herein uses numbers as game symbols, but the game is not limited to any type of game symbol.

Each playstation 100 in network 150 is assigned a game symbol or number 200. Preferably, adjacent playstations are assigned consecutive numbers if game numbers are used, and the numbers are prominently displayed on the playstations themselves. For example, game numbers may be chosen from the set of integers ranging from 1 through the number of playstations in the network, e.g., fifty. The range of game numbers is limited only by the number of playstations in the network, although usually there would be between 10 to 100 playstations.

To play, each player selects an unoccupied playstation. The player first establishes an account at that playstation using the means for inputting information, e.g., keyboard 130. There are several methods for establishing an account, including signing onto the playstation using a previously established account number, depositing funds into a funds acceptor 140 (shown in FIG. 1) that receives bills, coins or tokens, or using a credit voucher or card to identify the player and activate or establish an account for the player.

Once the player has established an account with a positive balance on the playstation, he or she can register a wager for the game. The player registers a wager by first selecting a quantity of distinct player symbols, e.g. numbers, from a set of game symbols, e.g., the set of game numbers. For example, as shown in FIG. 1, display device 120 of playstation 100 shows a grid 115 with all the numbers in the set of game numbers. The quantity of player numbers to be chosen may be established for the game configuration, or the player may have some discretion as to the quantity of numbers selected.

For example, as shown in FIG. 3, the player may select four numbers from the set integers from 1 to 50 in a game configuration containing 50 playstations. Thus, the player at playstation number 25 may choose, e.g., the numbers "2", "6", "14" and "25". A player's wager may or may not include the number assigned to his or her playstation. Optionally, a "quick pick" feature may be provided that would randomly select the player numbers for the player.

The player also places a monetary wager on the player numbers he has selected. In the example of FIG. 3, the player has wagered $1.00 on the game. Additionally, the player may make single or multiple wagers as desired or as permitted by the game configuration.

The time interval between games may be relatively short. For example, there may be a delay of between 30 seconds to 5 minutes between games. Players are encouraged to register their wagers quickly through a countdown timer 125 (shown in FIG. 1) displayed on the display device of each playstation. At a point in time, as determined either automatically or under the control of the system operator, the wagering period ends, and the game beings. When the wagering period has ended, players cannot place any additional wagers for that game.

Play of the game involves a drawing in which a quantity of winning symbols, e.g. numbers, is randomly selected from the set of game symbols. For example, four numbers may be drawn from the set of game numbers, i.e. the integers from 1 to 50. The drawing may be accomplished manually by a system operator or automatically using a random number generator 190 (shown in FIG. 2) in control processor 160. As each winning number is selected, the display device on each playstation indicates the winning number, e.g., by flashing the number on grid 115 on the player's playstation.

In one embodiment, control processor 160 controls selection of the winning symbols or numbers. For example, while random number generator 190 selects the number, lights 105 (shown in FIG. 1) associated with and/or attached to each playstation flash in series or randomly. When a winning number is selected by random number generator 190, the light associated with the playstation assigned to that number flashes continuously to indicate the winning number, and the winning number is also indicated on the playstation screens. The use of flashing lights 105 creates an exciting, suspenseful drawing event.

A prize may be awarded to a player who has placed a wager at the playstation associated with the winning symbol or number and continuously flashing light, i.e. a "lucky station" prize. There may also be a "lucky neighbor" prize awarded to any player occupying a playstation adjacent (numerically or otherwise) to the playstation associated with the winning symbol or number. For example, when a continuously flashing light indicates a winning number associated with a playstation, there will be a lucky station winner and two lucky neighbor winners, if all of these playstations are occupied by players. A player need not have selected the symbol or number associated with the playstation at which he or she is playing to win a lucky station or lucky neighbor prize; a player is entered in the lucky station/lucky neighbor drawing simply by selecting a playstation and placing a wager.

The drawing process is repeated until the quantity of winning symbols or numbers to be selected has been chosen. Following the selection of the winning symbols or numbers, prizes may be awarded automatically to all winning players. In particular, the prizes may be credited to the player's account on playstation 100.

Various different prize structures may be used for the game. For example, FIG. 4 shows a prize structure 210 for a system having 50 playstations, with four player numbers selected by each player and four winning numbers selected in the drawing. In this prize structure, the prize value increases with the quantity of matches between the player number and the winning numbers.

For example, if the player at playstation number 25 makes the wager shown in FIG. 3, and the winning numbers are "2", "7", "20" and "25", the player wins the lucky station prize ($2.00) and the prize for two matches ($10.00), for a total prize of $12.00. Thus, a player may win more than one prize if his or her wager includes the number associated with the player's playstation or his or her neighbor's playstation.

Other prize structures include bonus symbols or numbers, progressive wagering features, and additional betting options such as the additional selection of a color from a set of colors to win greater prizes.

Other embodiments are within the scope of the following claims.

What is claimed is:

1. A method of playing a game of chance, comprising providing a plurality of playstations, one of which is chosen by a player for entering a quantity of player symbols;

assigning a unique game symbol to each playstation of the plurality of playstations, the game symbol being chosen from a set of game symbols; and randomly selecting a quantity of winning symbols from the set of game symbols;

wherein the player wins the game if a predetermined number of the player symbols match the winning symbols or if the game symbol assigned to the player's playstation is related to one of the winning symbols in a predetermined manner.

2. The method of claim 1 wherein the player wins the game if the game symbol assigned to the player's playstation matches one of the winning symbols.

3. The method of claim 1 wherein the player symbols are chosen from the set of game symbols.

4. The method of claim 1 further comprising establishing a player account at the player's playstation.

5. The method of claim 1 further comprising automatically awarding a prize to a winning player through the winning player's playstation.

6. A method of playing a game of chance, comprising providing a plurality of playstations, one of which is chosen by a player for entering a quantity of player numbers;

assigning a unique game number to each playstation of the plurality of playstations, the game number being chosen from a set of game numbers; and randomly selecting a quantity of winning numbers from the set of game numbers;

wherein the player wins the game if a predetermined number of the player numbers match the winning numbers or if the game number assigned to the player's playstation is related to one of the winning numbers in a predetermined manner.

7. The method of claim 6 wherein the player wins the game if the game number assigned to the player's playstation matches one of the winning numbers.

8. The method of claim 6 wherein the player wins the game if the game number assigned to the player's playstation is numerically adjacent to one of the winning numbers.

9. The method of claim 6 wherein the step of randomly selecting the quantity of winning numbers is accomplished by a random number generator.

10. The method of claim 6 wherein the player numbers are chosen from the set of game numbers.

11. A game of chance to be played through a plurality of playstations, comprising a player's playstation chosen by a player from the plurality of playstations, each playstation including a processor for providing an indication of a quantity of player symbols;

a unique game symbol assigned to each playstation of the plurality of playstations, the game symbol being chosen from a set of game symbols; and a symbol selector for randomly selecting a quantity of winning symbols from the set of game symbols;

wherein the player wins the game if a predetermined number of the player symbols match the winning symbols or if the game symbol assigned to the player's playstation is related to one of the winning symbols in a predetermined manner.

12. The game of claim 11 wherein the player symbols are chosen from the set of game symbols.

13. The game of claim 11 wherein the playstations are electronic playstations.

14. The game of claim 13 wherein the playstations are interconnected via an electronic network.

15. The game of claim 11 wherein each playstation includes a display device.

16. The game of claim 15 wherein the display device is a touch-sensitive screen.

17. The game of claim 11 wherein each playstation includes a funds acceptor for establishing a player account.

18. A game of chance to be played through a plurality of playstations, comprising a player's playstation chosen by a player from the plurality of playstations, each playstation including a processor for providing an indication of a quantity of player numbers;

a unique game number assigned to each playstation of the plurality of playstations, the game symbol being chosen from a set of game numbers; and a number selector for randomly selecting a quantity of winning numbers from the set of game numbers;

wherein the player wins the game if a predetermined number of the player numbers match the winning numbers or if the game number assigned to the player's playstation is related to one of the winning numbers in a predetermined manner.

19. The game of claim 18 wherein the player numbers are chosen from the set of game numbers.

20. The game of claim 18 wherein set of game numbers is the set of integers from 1 through the number of the plurality of playstations.

21. The game of claim 18 wherein the number selector is a random number generator.

22. A game of chance to be played through a plurality of playstations, comprising a player's playstation chosen by a player from the plurality of playstations, each playstation including an indicator for providing an indication of a quality of player symbols;

a unique game symbol assigned to each playstation of the plurality of playstations, the game symbol being chosen from a set of game symbols; and a symbol selector for randomly selecting a quality of winning symbols from the set of game symbols;

wherein the player wins the game if a predetermined number of the player symbols match the winning symbols or if the game symbol assigned to the player's playstation is related to one of the winning symbols in a predetermined manner.

23. The game of claim 22 wherein the indicator comprises a keyboard.

24. The game of claim 22 wherein the indicator comprises a touch sensitive screen.

* * * * *